US006499143B2

(12) United States Patent
Garza

(10) Patent No.: US 6,499,143 B2
(45) Date of Patent: Dec. 31, 2002

(54) HOSPITAL GOWN

(76) Inventor: Ann Garza, P.O. Box 57704, Murray, UT (US) 84157

( * ) Notice: Subject to any disclaimer, the term of this patent is extended or adjusted under 35 U.S.C. 154(b) by 0 days.

(21) Appl. No.: 09/829,663

(22) Filed: Apr. 9, 2001

(65) Prior Publication Data

US 2002/0152535 A1 Oct. 24, 2002

(51) Int. Cl.[7] ..... A41D 13/00
(52) U.S. Cl. ..... 2/114; 2/69
(58) Field of Search ..... 2/69, 114, 104, 2/105, 106, 108, 80, 83

(56) References Cited

U.S. PATENT DOCUMENTS 459,106 A * 9/1891 Fifield ..... 2/114
818,351 A * 4/1906 Clark ..... 2/114
1,489,046 A * 4/1924 Thompson ..... 2/114
3,397,406 A * 8/1968 Leach ..... 2/114
5,564,126 A * 10/1996 Chou ..... 2/114
6,012,166 A * 1/2000 Burbidge ..... 2/114

* cited by examiner

*Primary Examiner*—Gloria M. Hale
(74) *Attorney, Agent, or Firm*—Brian C. Trask

(57) ABSTRACT

A hospital gown having closable openings on left and right sides to provide:access for physician examination to selectable portions of a patient's torso from either side, while substantially maintaining a cover over the unexamined portions.

15 Claims, 2 Drawing Sheets

HOSPITAL GOWN

BACKGROUND OF THE INVENTION

1. Field of the Invention

This invention relates generally to garments and clothing. It is particularly directed to a gown suitable for wear by a patient in a health care environment.

2. State of the Art

Patients commonly disrobe from their street clothes and don a loose-fitting, smock-like gown prior to undergoing an examination by a physician. The gown desirably provides the physician enhanced access to areas of a patient's body when compared with ordinary street clothes. Such a gown may be described in generic terms as a hospital gown. Hospital gowns may be employed in any situation where enhanced examination access to a variety of areas of a patient's body is desired.

A hospital gown will typically have enlarged neck and arm openings to facilitate passage therethrough of a physician's hand or instrument, and to accommodate patients having a variety of body dimensions. A single rear opening is usually provided, and may have one or more fasteners arranged to hold the edges of the opening closed to preserve the patient's privacy while walking about. However, it is often difficult for a patient to secure the fasteners, due to their rear location. Furthermore, such fasteners are typically insufficient to maintain the opening closed sufficiently to maintain the patient's privacy while walking. It is therefore common to see ambulatory patients holding their gowns closed behind their backs with one hand while moving about.

The rear opening of commercially available gowns provides direct access for examination of underlying posterior areas of a patient. However, to examine a frontal portion of a patient's torso, it may be required for the patient to at least partially remove the gown to expose the desired area for examination. In such case, the patient is subjected to a more intrusive exposure than that required simply to complete the examination. The additional required exposure of the patient's body may impose negative effects on the patient including coldness and a feeling of compromised modesty. Furthermore, the tied straps forming common closures are positioned such that patients sleeping on their backs unavoidably rest upon potentially aggravating bumps caused by the knots. In view of the current state of the art in hospital gowns, it would be an improvement to provide a gown offering improved access to substantially all areas of a patient's body while better maintaining a patient's privacy and improving their comfort.

BRIEF SUMMARY OF THE INVENTION

The present invention provides an apparatus for wear by a patient in a health care environment. The apparatus may generically be termed a hospital gown. A hospital gown according to the present invention permits physician access to substantially any portion of patient's body while substantially maintaining a protective cover over the unexamined areas of the patient's body.

A hospital gown according to the present invention typically includes front and back panels between at least substantially open left and right gown sides. Top edges of the panels are typically connected to form a neck opening. Releasable fastening structure is associated with both of the left and right gown sides, and is generally configured and arranged to at least substantially close the open sides of the gown and to allow for release whereby to provide physician access through an opening to selectable portions of a patient's body for examination while maintaining a cover substantially over the unexamined portion of the patient's body. Typical fastening structure includes a plurality of paired straps disposed at the gown sides and adapted to bring portions of the front and back panels into overlapable closure. Fastening structure may also include a plurality of strap holes disposed substantially in alignment between an attached first end of a strap and an edge of a panel adjacent to the strap attachment location. In such case, the strap holes are typically disposed to receive a cooperating strap in a stitched relation to improve integrity of an overlap between portions of the front and back panels. A gown desirably has an arm opening of adjustable size. Such an arm opening may be formed between fastening structure, such as a pair of straps, and a gown shoulder. Gowns desirably have a length between a top and a bottom sufficient to fall below a patient's knee when worn in a sitting position.

These features, advantages, and alternative aspects of the present invention will be apparent to those skilled in the art from a consideration of the following detailed description taken in combination with the accompanying drawings.

DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Reference will now be made to the drawings in which the various elements of the invention will be given numerical designations and in which the invention will be discussed so as to enable one skilled in the art to make and use the invention. It is to be understood that the following description is only exemplary of the principles of the present invention, and should not be viewed as narrowing the claims which follow.

Figure 1:
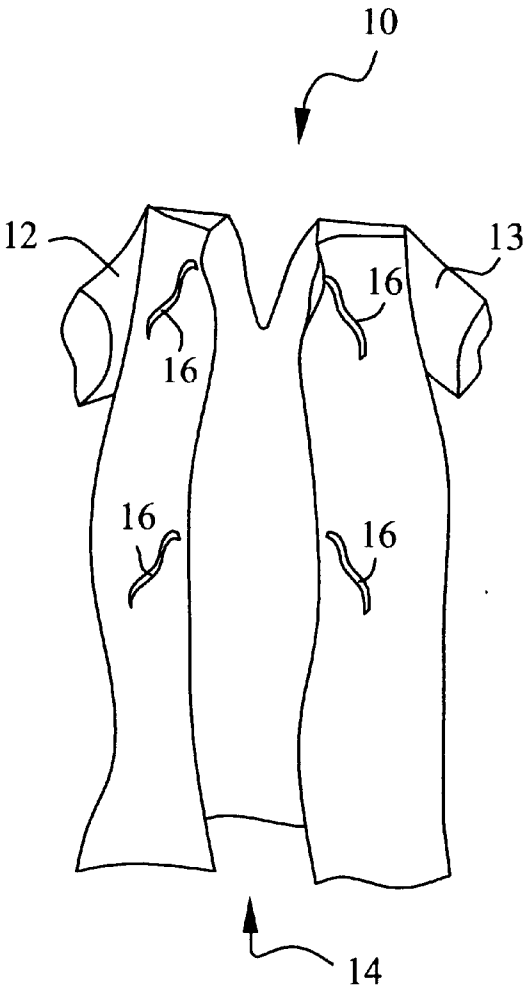
FIG. 1 PRIOR ART
FIG. 1 is a rear view in perspective of a prior art hospital gown.

FIG. 1 illustrates a rear view in perspective of a typical commercially available hospital gown, generally indicated at 10. The gown 10 may include sleeves 12 and 13, but is typified by a rear opening, generally indicated at 14. Sleeves 12 and 13, if included, are typically short. Paired straps 16 are generally provided at two locations along opening 14, as illustrated, and are operable to at least partially hold the gown closed. Gowns 10 may be provided in a variety of sizes to accommodate different sized patients from babies through large framed adults. The general pattern for all gown sizes is substantially the same as illustrated in FIG. 1.

A physician, when examining a patient wearing a gown 10, has direct access to examine only limited areas of the patient's torso. Direct and unrestricted access is available through the rear opening 14 only to areas of the patient's back. However, should the physician need to examine, e.g. a portion of the patient's front left torso, the physician must reach around the patient, and would have restricted visibility of the site. Alternatively, the patient may be required to remove the left sleeve 12 of the gown 10, essentially uncovering their entire upper left quadrant, to provide unrestricted visible access to the physician. In such case, the patient is required to expose a significant portion. of their body simply to provide access to a frontal site. Such exposure may cause the patient anguish from coldness and drafts in the room, or by unnecessarily compromising their modesty and privacy.

Figure 2:
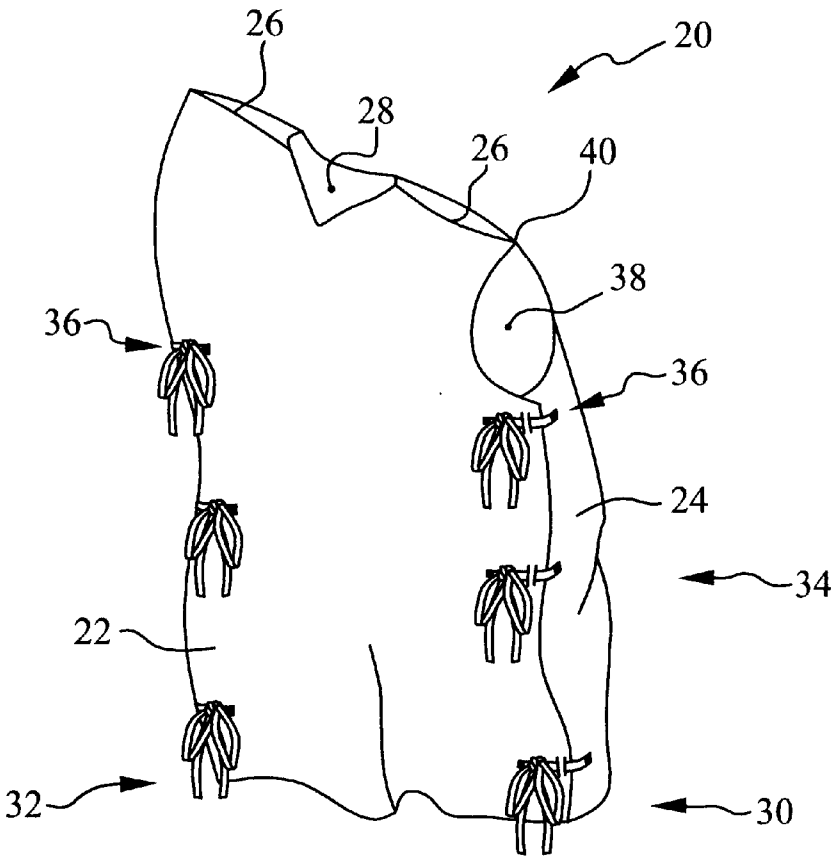
FIG. 2 is a front view in perspective of a preferred hospital gown the present invention.

An improved gown according to the present invention, and generally indicated at 20, is illustrated by a front view in perspective in FIG. 2. The gown 20 may be described as having a front panel 22 and a back panel 24 joined at a top edge 26 to form a neck opening 28. Alternatively, a neck opening 28 may be formed in a single, folded over, and contiguous, panel. Left side opening 30 and right side opening 32 are provided at left and right sides of a gown 20, respectively. The openings 30, 32 may be full length, as illustrated in FIG. 2, or may be partial length. If openings 30, 32 are partial length, a gown side, generally indicated at 34, may include one or more seams or connections between front panel 22 and back panel 24. It is within contemplation also to provide a plurality of openings disposed on left and right sides of a gown 20.

As illustrated in FIG. 2, fastening structure, generally indicated at 36, is typically provided at a plurality of locations releasably to hold the gown closed. The number and arrangement of fastener locations may be varied as desired. It is currently preferred to position fasteners at three locations, substantially as illustrated. An adjustable-in-size arm opening 38 is typically formed between a fastener structure 36 and a shoulder 40 of gown 20. A sleeve of any length may additionally be provided at arm opening 38, although it is currently preferred for a gown 20 to be sleeveless. Illustrated gown 20 may be regarded as having substantially open left and right sides which may be held substantially closed, and even overlapping, by fastening structure 36. It should be noted that, in the illustrated preferred embodiment of FIG. 2, the fastening structure 36 is positioned relatively forward for easy patient access. Locating fastening structure at the patient's sides also affords the patient lump-free front and rear supine support surfaces.

Figure 3:
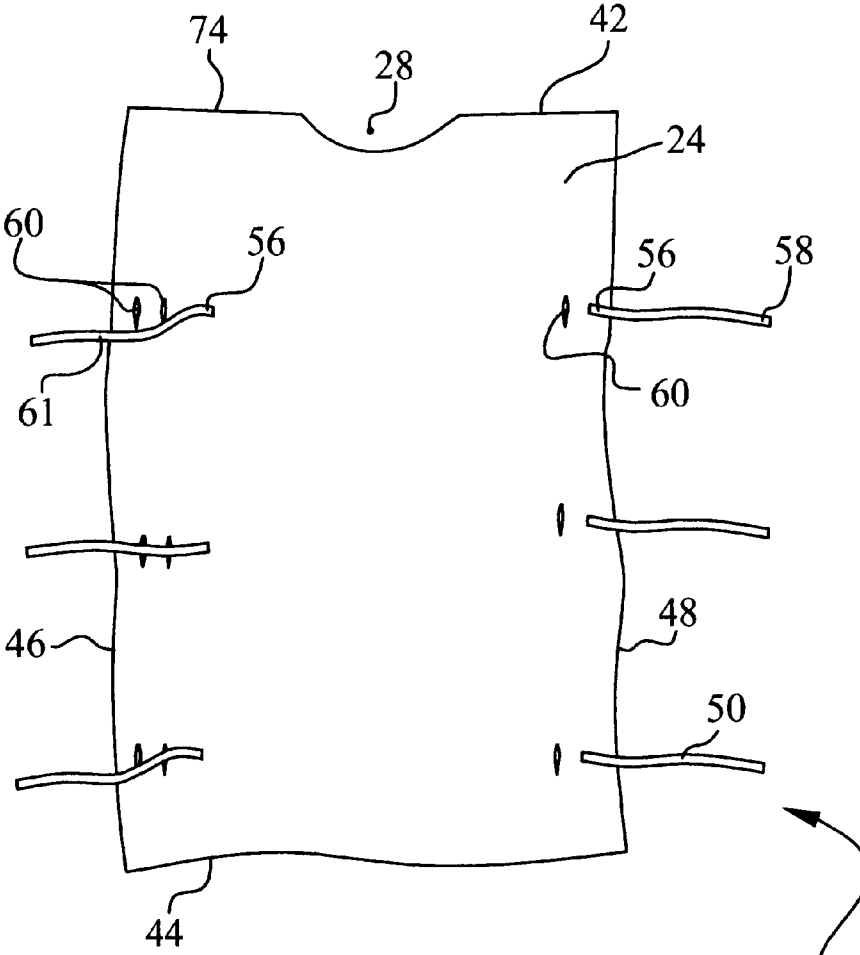
FIG. 3 is a rear view of an alternative hospital gown according to the present invention.

Additional details of the invention will now be described making reference to the alternative embodiment illustrated in FIGS. 3 and 4. With reference to FIG. 3, a back panel 24 may be described as having a top edge 42, a bottom 44, a left side 46, and a right side 48. With additional reference to FIG. 4, closure structure 36 may include a back strap 50 paired with a front strap 52.

Straps, such as illustrated by strap 54 in FIG. 3, are generally attached to a panel at a first end 56, and have a length between a first end 56 and a second end 58 that is unattached. Attached end 56 is typically spaced from an edge of the panel to which it its attached to allow for an adjustment in girth of the assembled gown. Cooperating paired straps (such as straps 54 and 59) are therefore operable to form a tied coupling releasably to close an opening, such as an opening 30 (see FIG. 2) and to adjust the girth of a gown to fit patients of several sizes. Sometimes one or more through-holes 60 may be provided in a panel, and through which holes 60 a strap may be passed in a stitched arrangement to improve the integrity of an overlap between front and back panels 22 and 24 respectively.

It is currently preferred for a plurality of holes 60 to be disposed between a strap attached end 56 and an edge of the panel to which it is attached. Alternative configurations are also within contemplation. However, the aforementioned arrangement allows a paired strap to be passed through two or more holes 60 to help create a panel overlap. It is also within contemplation for material carried by an overlapped panel between a pair of holes 60 to be drawn through a "wider" hole 60 through the overlapping panel prior to stitching a strap through the overlapped panel material. In such an arrangement, the material of the overlapped panel that is drawn through the overlapping panel may be visualized as a belt loop protruding through a "wider" hole 60 in the overlapping panel. A strap may then be passed, or stitched, through the "belt loop" effectively to improve integrity of an overlapping section of panels. In such an arrangement, the overlapped panel section is substantially prevented from folding back inadvertently to form an opening which might reveal portions of the patient.

Figure 4:
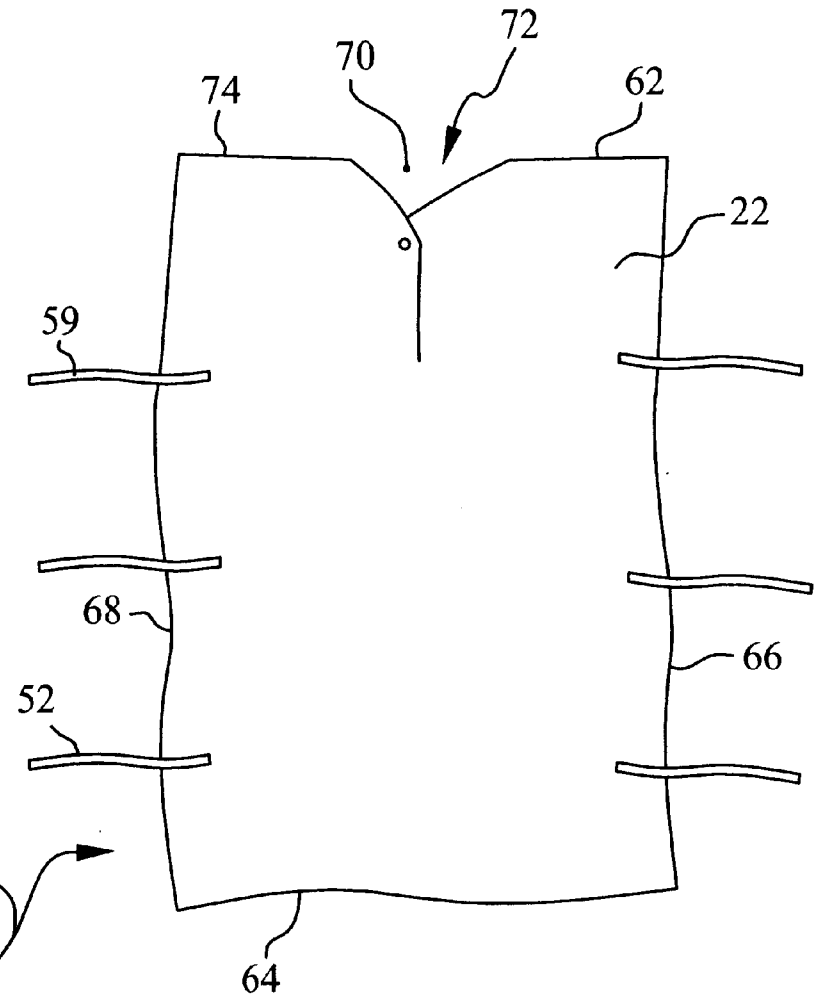
FIG. 4 is a front view of the embodiment of FIG. 2.

With reference now to FIG. 4, a front panel 22 may be described as having a top edge 62, a bottom 64, a left side 66, and a right side 68. An enlargable neck opening 70 may be provided, rather than a fixed size opening 28. In such case, fastening structure 72 is typically configured releasably to hold the enlargable portion in a closed configuration. It is currently preferred to connect a top edge 62 of a front panel 22 to a top edge 42 of a back panel 24 by a stitched seam 74. However, it is within contemplation alternatively to provide fastening structure adapted releasably to hold the top panel edges together.

The gown 20 may be manufactured from any sort of drapable cloth-like material, including without limitation: cloth made from any material, plastic, paper, natural and synthetic fiber, and the like. Currently, it is preferred to manufacture gowns 20 from a durable cloth material which may be laundered for reuse. However, alternate material may be employed for single sterile use prior to disposal. One material that is suitable for construction of a gown 20 is cotton flannel. In general, fastening structure 36 and 72 may be any sort of structure adaptable releasably to hold an opening in a closed configuration. Fastening structure within contemplation nonexclusively includes: snaps, catches, latches, toggles, buttons, straps and strings, and hook-and-loop closures.

The invention provides improved physician access to all areas of a patient's torso, without requiring the patient to expose significantly more than the examination site. For example, a physician may examine either a front or rear portion of a patient simply by releasing closure structure 36 nearest the site of interest. The material of the gown local to the examination site may then be folded to one side, providing direct visual access to the examined portion while substantially maintaining a cover over the unexamined portions of the patient. Of course, a physician may also pass a hand or instrument through an opening to examine a site or make a measurement without actually moving the gown material for visible access to the site. The arrangement of openings 30 and 32 on both sides of the gown 20 provides access to all areas of a patient without requiring a physician to reach past a midplane of the patient. A bedridden patient may be examined while supine and substantially fully covered by the gown 20, and at most, might have to roll on their side to afford physician access to posterior locations.

The invention may also be directed to improve a patient's comfort and maintain modesty. A patient may obtain psychological benefit from a gown made of a material having a color and/or decorative pattern that is calming and comforting. Gowns 20 are desirably made from a material that is soft and feels comfortable when worn next to a patient's skin.

Ambulatory patients benefit from gowns 20 having closure structure adapted to maintain an overlap, without additional manual assistance, between portions of front and rear panels 22 and 24, respectively. A gown 20 will also desirably have a length, between a shoulder 40 and a bottom edge 64, of sufficient length that edge 64 falls below the patient's knee when sitting.

While the invention has been described in particular with reference to certain illustrated embodiments, such is not intended to limit the scope of the invention. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A gown for use by a patient in a health care environment, comprising:

a front panel having a front top edge, a front bottom edge, a front left side and a front right side;

a back panel having a back top edge, a back bottom edge, a back left side and a back right side, said front and back panels comprising drapable material and being connected at said front and back top edges to form a neck opening of said gown, the bottom of said gown comprising said front and back bottom edges, said front left and back left sides corresponding to a left side of said gown, said front right and back right sides corresponding to a right side of said gown; and releasable fastening structure associated with left and right openings disposed respectively on said left and right sides of said gown, said fastening structure being adjustable to change a girth of said gown and being operable to maintain an overlap between front and rear portions of said gown at said left and right openings, and being configured and arranged for selectable release whereby to expose desired underlying portions of a patient's body for examination, wherein:

said fastening structure comprises a plurality of paired front and back straps, a first end of each front strap being attached adjacent to a side of said front panel, a first end of each back strap being attached adjacent to a side of said back panel, the attachment location of at least one of said paired straps being spaced apart from an edge of said side to form an overlappable side closure in said gown functional to maintain a patient's modesty, and with a length between said first end and a second end of each strap being unattached and operable to form a tied coupling with its paired strap.

2. The gown according to claim 1, further comprising a strap hole disposed between a said first end of a strap and an edge of its adjacent side, said strap hole accommodating a paired strap to create a variable overlap between front and back panel sides whereby to change the girth of said gown.

3. The gown according to claim 2, further comprising a plurality of strap holes disposed substantially in alignment between a said first end of a strap and an edge of its adjacent side, said strap holes being disposed to receive a paired strap in a stitched relation to improve integrity of an overlap between sides of said front and back panels.

4. The gown according to claim 1, said fastening structure comprising three pairs of straps disposed at each of said left and right sides of said gown.

5. The gown according to claim 1, further comprising an arm opening of adjustable size and formed between a pair of said straps and a shoulder of said gown.

6. A hospital gown comprising:

front and back panels between at least substantially open left and right gown sides, a top edge of said panels being connected to form a neck opening; and releasable fastening structure associated with both of said left and right gown sides, said fastening structure comprising a plurality of paired straps disposed at said sides to bring portions of said front and back panels into overlapping closure and being operable to maintain an overlap between front and rear portions of said gown at said left and right openings, and being configured and arranged to at least substantially close said open sides of said gown and to allow for release whereby to provide physician access through an opening to selectable portions of a patient's body for examination while maintaining a cover substantially over the unexamined portion of the patient's body.

7. The gown according to claim 6, the attachment location of at least one of said paired straps being spaced apart from an edge of said side to form an overlappable side closure in said gown functional to maintain a patient's modesty.

8. The gown according to claim 7, further comprising a plurality of strap holes disposed substantially in alignment between an attached first end of a strap and an edge of a panel adjacent to said strap, said strap holes being disposed to receive a cooperating strap in a stitched relation to improve integrity of an overlap between portions of said front and back panels.

9. The gown according to claim 7, further comprising an arm opening of adjustable size and formed between a pair of said straps and a side of a top edge.

10. The gown according to claim 7, said front panel comprising a length between a top and a bottom sufficient to fall below a patient's knee when worn in a sitting position.

11. An improved hospital gown, the improvement comprising:

openings disposed in said gown at left and right side locations corresponding to left and right sides of a patient wearing said gown, said openings being configurable to provide physician access to selectable areas of said patient's torso; and fastening structure disposed in association with said openings and being operable to maintain an overlap between front and rear portions of said gown at said openings, and operable for release whereby to provide said access through said openings, said fastening structure comprising a plurality of paired front and back straps, a first end of each front strap being attached to a front of said gown adjacent to a said opening, a first end of each back strap being attached to a back of said gown adjacent to a said opening, a length between said first end and a second end of each strap being unattached and operable to form a tied coupling with its paired strap.

12. The gown according to claim 11, further comprising an arm opening of adjustable size and formed between a said fastening structure and a shoulder of said gown.

13. The gown according to claim 12, said fastening structure being operable to create an overlap between front and back side portions of said gown.

14. The gown according to claim 11, further comprising a plurality of strap holes disposed substantially in alignment between a said first end of a strap and its adjacent opening, said strap holes being disposed to receive a paired strap in a stitched relation to improve integrity of an overlap between side portions of said gown.

15. The gown according to claim 14, said gown comprising a length between a shoulder and a bottom sufficient for said bottom to remain below a patient's knee when worn in a sitting position.

* * * * *